United States Patent [19]

Reavis, Jr.

[11] 3,950,062

[45] Apr. 13, 1976

[54] WIRE SLOT TERMINAL DOUBLE BEAM SYSTEM

[75] Inventor: Robert Philmore Reavis, Jr., Statesville, N.C.

[73] Assignee: AMP Incorporated, Harrisburg, Pa.

[22] Filed: July 23, 1974

[21] Appl. No.: 490,838

[52] U.S. Cl. ..... 339/97 R

[51] Int. Cl.[2] ..... H01R 9/08

[58] Field of Search ..... 339/97–99, 339/95

[56] References Cited

UNITED STATES PATENTS 3,605,072 9/1971 Driscoll ..... 339/98

*Primary Examiner*—Joseph H. McGlynn

*Attorney, Agent, or Firm*—Robert W. Pitts; Frederick W. Raring; Jay L. Seitchik

[57] ABSTRACT

A solderless plate-like wire connector suitable for insertion of two or more conductors into a single slot is presented. This connector is of the type in which a conductor is inserted into a slot with the edges of the slot penetrating the insulation and establishing electrical contact with the conductor. An arrangement of internal slots defining isolated internal beam systems is utilized. The existence of separate internal and external beam systems each acting primarily on different conductors minimizes the effect of one conductor on the stress exerted on the other conductor in the same slot.

8 Claims, 8 Drawing Figures

WIRE SLOT TERMINAL DOUBLE BEAM SYSTEM

BACKGROUND OF THE INVENTION

This invention pertains to solderless wire connectors or terminals used for making electrical connection with insulated conductors or wires. Although the term wire is used almost exclusively in the following, that term is intended to include conductors of non-circular as well as circular crosssection. Electrical contact is accomplished by forcing the wire into a slot. The slot is too narrow to accept both the wire and its insulation. The insulation is sheared away by the edges of the slot and contact is made with the underlying wire. The diameter of the bare wire itself is generally greater than the width of the slot. When the wire is forced into the slot its cross-section is deformed. The resulting residual stresses assure a good electrical contact and firmly hold the wire in the slot.

Many different inventions employ this technique, of which U.S. Pat. No. 3,012,219 U.S. Pat. No. 3,234,498 and French Pat. No. 919,480 are only three. The invention herein disclosed however, deals with the insertion of two or more wires into a single slot. U.S. Pat. No. 3,605,072 is the only patent mentioning such an arrangement which has been found.

Simply inserting two wires in a single conventional slot can lead to difficulties. Deformation will occur not only in the first wire inserted into the slot, but also in the slot itself. The slot will be enlarged by the presence of the first wire and the second wire will not be gripped as firmly as a single wire in that position would have been. It is the purpose of the present invention to provide an arrangment in which the forces acting on one wire may be isolated from the effects of the other wire. The invention disclosed in the following embodiments utilizes isolated beam systems to exert stresses on each wire independently.

Typical embodiments incorporating this invention are shown in the accompanying drawings. The action of the invention is also demonstrated.

Figure 1:
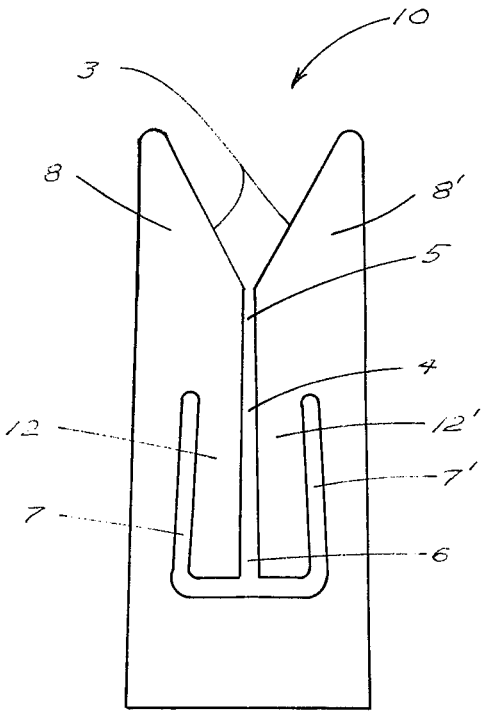
FIG. 1 is a view of a typical embodiment of the invention employing internal slots to form internal cantilever beams.

The embodiment shown in FIG. 1 demonstrates some of the features common to each of the embodiments shown. This connector 10 formed of a suitable conducting material has a central wire-receiving slot 4 which separates its two main cantilever beam arms 8 and 8'. The wire-receiving slot 4 extends inwardly from the wire-receiving end 3 of the connector 10. The wire-receiving end 3 is generally V-shaped providing easy alignment of the wire with the slot 4. When the wire is moved laterally of its axis into the wire-receiving slot 4, its insulation is cut by the ends of the slot 4 near the wirereceiving end 3.

In a typical slot-type connector, a wire in the central slot 4 would be under stresses caused by the action of the two opposed cantilever beam arms 8 and 8'. This connector, as well as all of the others employing this invention, contains additional slots 7 and 7' located beside and essentially parallel to the central wire-receiving slot 4. Each additional slot 7 or 7' defines an internal beam in this figure 12 and 12' respectively which extends along and beside a portion of the wire-receiving slot 4. A wire located in the lower parts 6 of the wire-receiving slot 4 would then be between the additional slots 7 and 7'. This lower wire would be subject to the stresses exerted by the internal beams defined by the additional slots 7 and 7'. A wire located in the upper part 5 of the wire-receiving slot 4 would be essentially isolated from the action of the internal beams.

The features shown in FIG. 1 are generally common to the other embodiments shown and the numbering used in FIG. 1 has been largely retained throughout.

Figure 2:
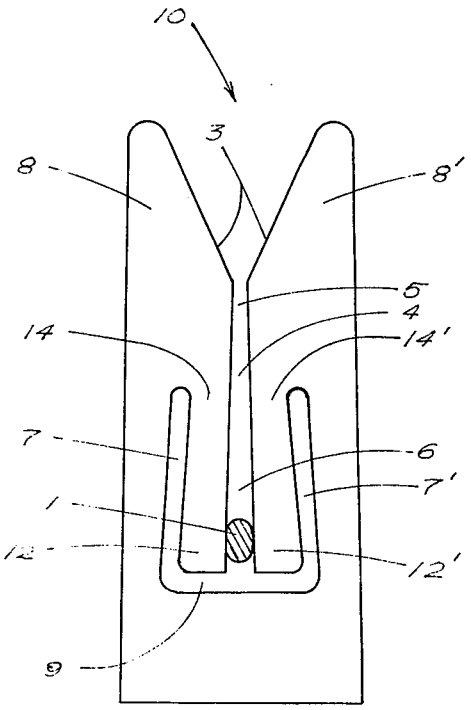
FIG. 2 shows a typical connector with one wire inserted.

FIG. 2 shows the same connector as in FIG. 1. The additional slots 7 and 7' and the wire-receiving slot 4 are joined by a transverse slot 9. These four slots thus form two internal cantilever beams 12 and 12'. A cross-section of the first wire 1 is shown after it has been inserted in slot 4 in the neighborhood of position 6. Position 6 is between the internal beams 12 and 12'. The deflection of beams 12 and 12' by wire 1 is also shown. These cantilever beams pivot about their ends 14 and 14'. Most of the stress caused by insertion of the first wire 1 will be concentrated in the area between the pivots 14 and 14' and the location of the first wire 1.

Figure 3:
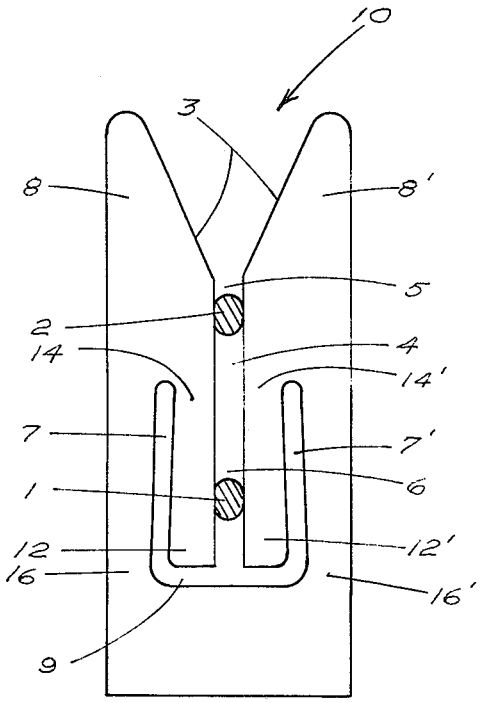
FIG. 3 shows the same connector after insertion of a second wire.

FIG. 3 shows the same connector after insertion of the second wire 2. The second wire is located at position 5 between the wire-receiving end 3 and the additional slots 7 and 7'. This second wire 2 is then under the influence of two external cantilever beams 8 and 8' but is essentially free from the influence of the internal beam system. The external cantilever beams 8 and 8' pivot about their ends 16 and 16' respectively. Stresses caused by wire 2 are then substantially localized between wire 2 and each of the internal beams' ends 16 and 16'.

Figure 4:
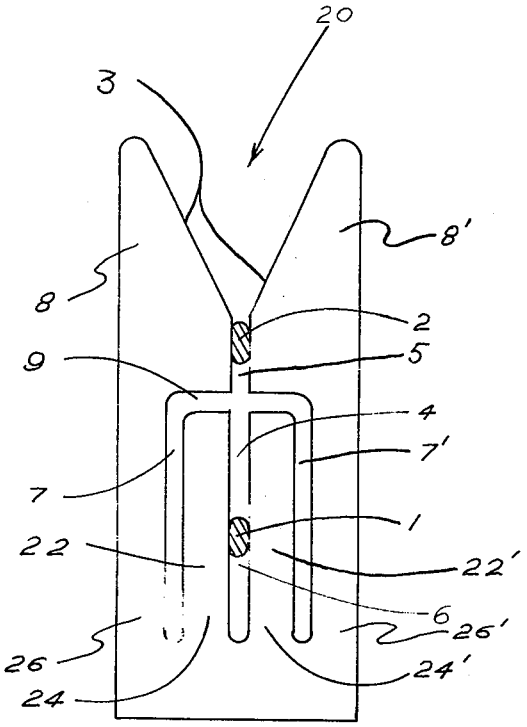
FIG. 4 shows an alternate embodiment with a different arrangement of the internal cantilever beams.

FIG. 4 shows a slightly different arrangement. In this connector 20, the transverse slot 9 joins the two additional slots 7 and 7' and the central wire receiving slot 4 at a point between wires 1 and 2. The slots then outline a rudimentary M rather than a W. The additional slots 7 and 7' again form internal cantilever beams 22 and 22'. These internal cantilever beams 22 and 22' pivot about ends 24 and 24' which are located adjacent to the inner ends of the additional slots 7 and 7'. The external cantilever beams or arms 8 and 8' pivot about their ends 26 and 26'. In this particular arrangement both the internal and external cantilever beams pivot about the area of the innermost ends of the additional slots 7 and 7'. The stress patterns produced by this arrangement will, of course, differ from that produced in FIG. 3.

Figure 5:
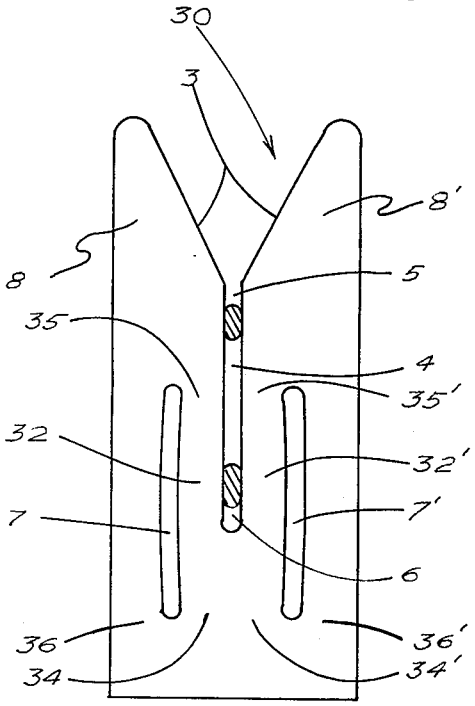
FIG. 5 is another alternate embodiment employing internal fixed end beams.

FIG. 5 shows a third arrangement of the internal beam system. In connector 30, the additional slots 7 and 7' are not joined by a transverse slot. Internal beams 32 and 32' with fixed ends 34, 35, 34', and 35' respectively are then formed. The first wire 1 is now stressed by the internal fixed end beams 32 and 32' while the second wire 2 is still under the influence of external cantilever beams 8 and 8' which are similar to those in connectors 20 and 30. The deflection of the internal fixed end beams 32 and 32' is greatly exaggerated here.

Figure 6:
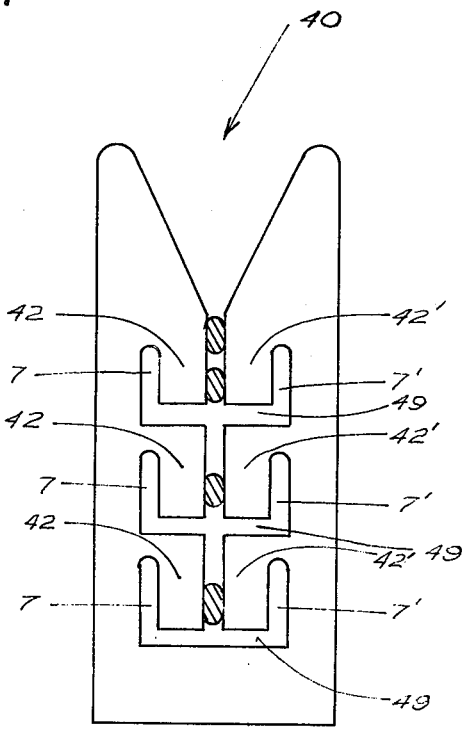
FIG. 6 is a connector employing this invention and capable of accommodating more than two wires in the same slot.

FIG. 6 shows connector 40 which is in reality no more than a repetitious version of connector 10. Multiple pairs of additional slots 7 and 7' are joined by multiple transverse slots 49 to form multiple internal cantilever beams 42 and 42'. The internal slot arrangement of either connector 20 or 30 could also be repeated in this manner.

Figure 7:
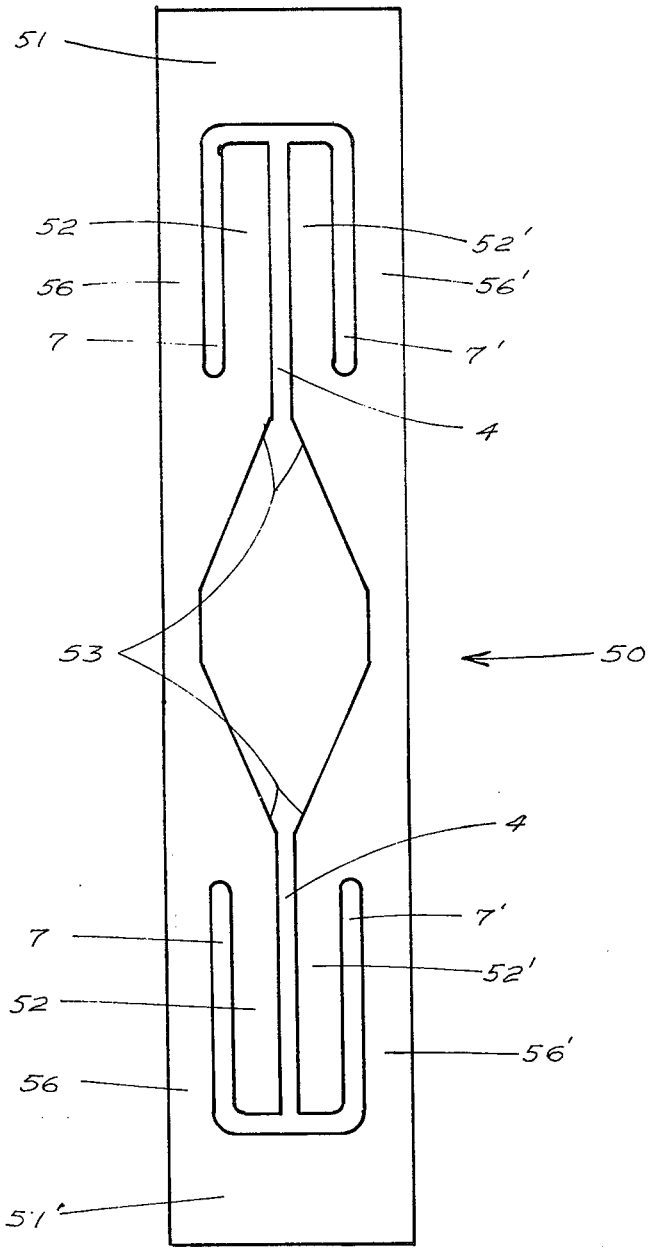
FIGS. 7 and 8 show a connector with two legs each with slots containing both wires and providing a degree of strain relief for the wires.
Figure 8:
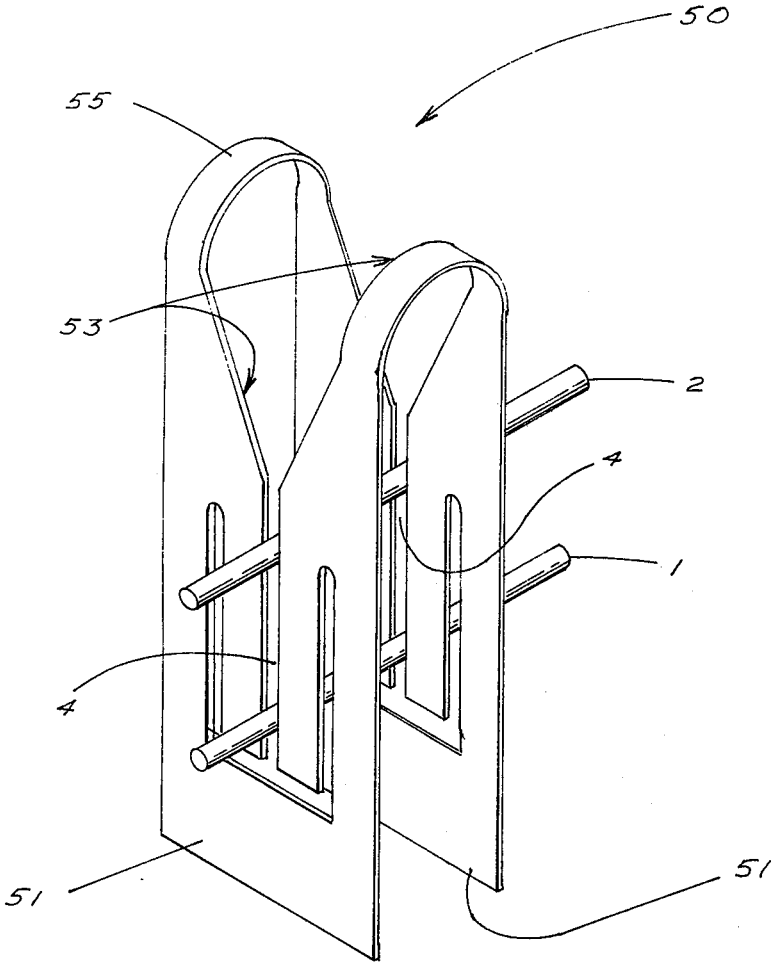

Connector 50, shown in FIG. 7 and 8, is another embodiment that could employ any of these internal slot arrangements. As shown in FIG. 7, the plate-like connector 50 is symmetrical about both its horizontal and vertical axis. An area 53, roughly in the shape of a diamond, has been cut from the center of connector 50. Slots 4 extend from the top and bottom of the diamond-shaped cut-out 53. A slot pattern like that shown in connector 10 in FIGS. 2 and 3 is then repeated on the top and bottom of the cut-out 53. FIG. 8 shows the connector 50 after it has been bent about the horizontal center-line of the flat plate shown in FIG. 7. A U-shaped connector with two legs having identical slot patterns then is formed. The diamond-shaped cut-out 53 now forms the V-shaped wire receiving ends 53 of the two legs 51 and 51' of connector 50. The wire receiving slots 4 in each leg are in alignment and both wires can be inserted into the two slots simultaneously. This twin beam arrangement has certain advantages. Two electrical contacts on each wire should insure a more reliable system. One leg can also serve as an anchor providing a measure of strain relief to prevent deterioration in the contact established by the other leg.

What is claimed is:

1. The combination of a connecting device and two conductors which are in electrical contact with said connecting device:

said connecting device comprising a platelike member having a conductor-receiving end, a conductor-receiving slot extending inwardly from said conductor-receiving end, said conductor-receiving slot having an inner end which is remote from said conductor-receiving end, said conductor-receiving slot having a width which is less than the width of said conductors, additional slot means in said plate-like member, said additional slot means extending beside, on each side of, said conductor-receiving slot, said additional slot means having first ends which are proximate to, and spaced from, said conductor-receiving end of said plate-like member, said additoonal slot means having second ends which are remote from said conductor-receiving end and adjacent to said inner end of said conductor-receiving slot, the length of said conductor-receiving slot being greater than the length of said additional slots, one of said conductors being in said conductor-receiving slot at a location between said first and second ends of said additional slot means, said one conductor being resiliently compressed by opposed edge portions of said conductor-receiving slot under the influence of a first pair of stressed beams in said plate-like member on each side of said conductor-receiving slot, said first pair of stressed beams being defined by said conductor-receiving slot and said additional slot means, the other one of said conductors being in said conductor-receiving slot at a location between said first ends of said additional slot means and said conductor-receiving end of said plate-like member, said other conductor being resiliently compressed by opposed edge portions of said conductor-receiving slot under the influence of a second pair of stressed beams, said second pair of stressed beams comprising cantilever beams extending from portions of said plate-like member on each side of said conductor receiving slot, transverse slot means connecting said conductor receiving slot and said additional slot means.

2. The combination set forth in claim 1 having additional conductors other than the said two conductors, also in electrical contact with said connecting device, located in said conductor-receiving slot, with said additional conductors located between said two conductors in said conductor-receiving slot, said additional slot means also having additional ends other than said first and second ends, said additional slot means having two additional ends between each of said conductors in said conductor-receiving slot, each of said conductors other than said second conductor proximate to said conductor-receiving end being under the influence of a separate pair of stressed internal beams in said plate-like member.

3. A combination as set forth in claim 1 with said second ends of said additional slot means proximate to said inner end of said conductor-receiving slot being connected by said transverse slot means extending between said second ends of said additional slot means and intersecting said inner end of said conductor-receiving slot.

4. A combination as set forth in claim 1 with said first ends of said additional slot means being connected by said transverse slot means extending between said second ends of said additional slot means and intersecting said conductor-receiving slot at point between said ends of said conductor-receiving slot.

5. A device for forming an electrical connection with at least two conductors, said device comprising:

a generally plate-like member having a conductor receiving end and having a conductor-receiving slot extending therein from said conductor-receiving end, said conductor-receiving slot having an inner end, said slot having a width which is less than the diameter of said conductors, additional slot means in said member, said additional slot means extending beside, and spaced from, said conductor-receiving slot on at least one side thereof, said additional slot means having one dead end, said additional slot means having a second end portion extending transversely towards, and intersecting said conductor-receiving slot, said additional slot means defining an internal cantilever beam means on at least one side of said conductor-receiving slot, said internal cantilever beam means having one free end, whereby upon moving one wire laterally of its axis into said conductor-receiving slot, said one conductor will be engaged by said internal cantilever beam means to establish an electrical contact therewith, and a second conductor when moved laterally of its axis into said conductor-receiving slot will be engaged by the edge portions of said conductor-receiving slot and establish electrical contact therewith without substantially effecting said internal cantilever beam means.

6. A device as set forth in claim 5, having second additional slot means defining separate cantilever beam means on opposite sides of said conductor-receiving slot.

7. A device as set forth in claim 5 having said second end portion of said additional slot means proximate to said inner end of said conductor-receiving slot and extending transversely towards, and intersecting said inner end of said conductor-receiving slot defining said cantilever beam means, said cantilever beam means having a free end adjacent to said inner end of said conductor-receiving slot.

8. A device as set forth in claim 5 having said dead end of said additional slot means proximate to, and spaced laterally from, said inner end of said conductor-receiving slot, said second end portions of said additional slot means extending transversely towards, and intersecting said conductor-receiving slot between said inner end of said conductor-receiving slot and said conductor-receiving end.

* * * * *